US005255913A

United States Patent [19]

Tsuchida

[11] Patent Number: 5,255,913

[45] Date of Patent: Oct. 26, 1993

[54] WOOD GOLF CLUB HEAD

[75] Inventor: Atsushi Tsuchida, Shizuoka, Japan

[73] Assignee: Yamaha Corporation, Japan

[21] Appl. No.: 758,453

[22] Filed: Sep. 6, 1991

Related U.S. Application Data

[63] Continuation-in-part of Ser. No. 592,856, Oct. 4, 1990, abandoned.

[30] Foreign Application Priority Data

Oct. 9, 1989 [JP] Japan ..... 1-263647

[51] Int. Cl.[5] ..... A63B 53/04

[52] U.S. Cl. ..... 273/78; 273/173

[58] Field of Search ..... 273/167 R, 167 F-167 K, 273/168, 169, 173, 78

[56] References Cited

U.S. PATENT DOCUMENTS

| | | | |
|---|---|---|---|
| 2,171,383 | 8/1939 | Wettlaufer | 273/171 |
| 3,266,805 | 8/1966 | Bulla | 273/78 |
| 4,021,047 | 5/1977 | Mader | 273/167 H |
| 4,214,754 | 7/1980 | Zebelean | 273/167 H |
| 4,432,549 | 2/1984 | Zebelean | 273/167 H |
| 4,438,931 | 3/1984 | Motomiya | 273/167 H |
| 4,545,580 | 10/1985 | Tomita et al. | 273/167 R |
| 4,762,322 | 8/1988 | Molitor et al. | 273/167 H |
| 4,811,949 | 3/1989 | Kobayashi | 273/167 H |
| 4,824,110 | 4/1989 | Kobayashi | 273/78 |
| 4,872,685 | 10/1989 | Sun | 273/169 |

FOREIGN PATENT DOCUMENTS

| | | | |
|---|---|---|---|
| 1-190374 | 7/1989 | Japan | 273/167 R |
| 1534471 | 12/1978 | United Kingdom | 273/78 |

*Primary Examiner*—V. Millin
*Assistant Examiner*—Steven B. Wong
*Attorney, Agent, or Firm*—Ostrolenk, Faber, Gerb & Soffen

[57] ABSTRACT

In construction of a shell-type wood golf club head, at least its crown is made of a material of a rigidity lower than that of a material forming the other sections of the club head. The crown exhibits upward elastic deformation upon striking a ball and allows the face to incline rearwards, thereby providing a temporarily increased loft which suppresses undesirable back spin of the balls and assures longer shots and smooth run of the balls after landing.

2 Claims, 4 Drawing Sheets

REDUCTION IN ROTATION X 10^3 (R.P.M.)
2
1
0
1
2
3
FACE INCLINATION ANGLE (DEGREE)

CROWN RIGIDITY x 10^2 (N•M)
5
4
3
2
1
0
1
2
3
FACE INCLINATION ANGLE (DEGREE)

WOOD GOLF CLUB HEAD

CROSS-REFERENCE TO RELATED APPLICATION

This application is a continuation-in-part of applicant's co-pending application Ser. No. 07/592,856, filed Oct. 4, 1990, now abandoned.

BACKGROUND OF THE INVENTION

The present invention relates to a wood golf club head, and more particularly relates to a shell-type head of a wood golf club which assures longer shots.

Wood golf club head now in the market are roughly classified into two groups, one being a solid-type and the other a shell-type. The solid-type head is generally made of wood such as persimmon and has a uniform construction over the entire body. The shell-type is further classified into two groups. One type includes a caveats construction defined by a shell made of metal or FRP (fiber reinforced plastics) and the other type includes a core made of foam resin or the like and wholly embraced by a like shell.

In either case, the configuration of a head main body is generally defined by six continuous sections, i.e. a face, a sole, a back, a crown, a toe and a heel. More specifically, the face extends normal to the shooting direction and is used for shoot balls, the sole forms the bottom of the main body, the back is located opposite to the face in the shooting direction and the toe and the heel extend substantially in parallel to the shooting direction. In particular the face plays an important role in striking a ball. Generally, the face has an inherent loft in accordance with the number of the associated golf club and provided with a plurality of fine transverse grooves for direction control of struck balls. Further, a separate face plate is attached to the sweet spot of the face for increased repulsion when striking balls.

With an increase in the number of a club, the face of its head main body has an increased loft which provides increased striking angle for longer shot. Despite this merit, increase in loft results in a larger back spin which hampers good run of a ball struck by the head. In particular, in the case of head wind, increased back spin tends to cause unintended lift of balls. As a result, the flying or carry distance of balls is not as long as intended by the loft of to the face of the head main body.

SUMMARY OF THE INVENTION

It is the object of the present invention to assure longer shots without any corresponding increase in loft of the face of a club head.

In accordance with the present invention, at least the crown of a club head is made of the first shell having rigidity lower than that of the second shell forming other sections of the club head.

DESCRIPTION OF THE PREFERRED EMBODIMENTS

Figure 1:
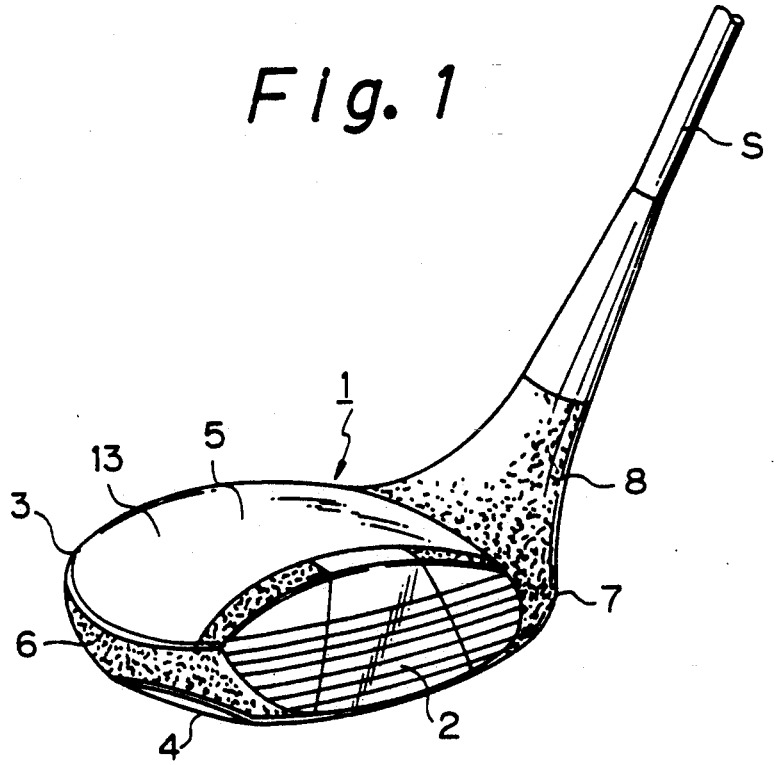
FIG. 1 is a perspective view of the golf club head in accordance with the present invention.

One typical configuration of the club head in accordance with the present invention is shown in FIG. 1, in which the head main body 1 is defined, as in the conventional ones, by six sections, i.e. a face 2, a back 3, a sole 4, a crown, a toe 6 and a heel 7. These sections are each given in the form of a curved surfaces of a large radius of curvature. The head main body 1 is connected to a shaft S via a hosel 8 substantially conical in shape. The face 2 is accompanied with a face plate made of hardened FRP or ceramics.

Figure 2:
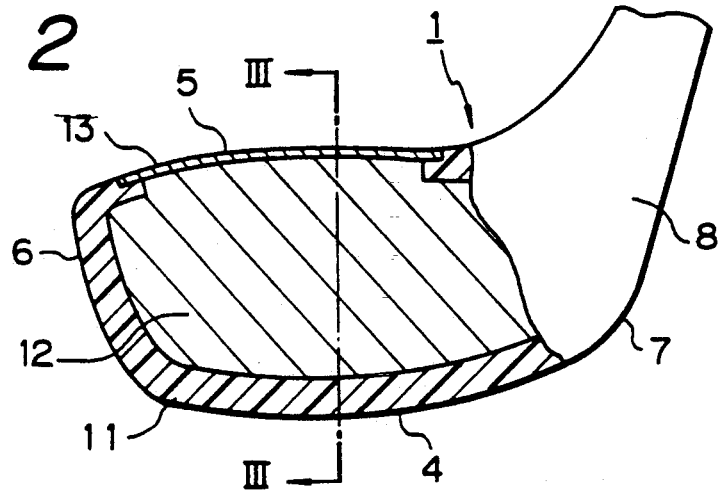
FIG. 2 is a side view, partly in section, of the golf club head shown in FIG. 1.
Figure 3:
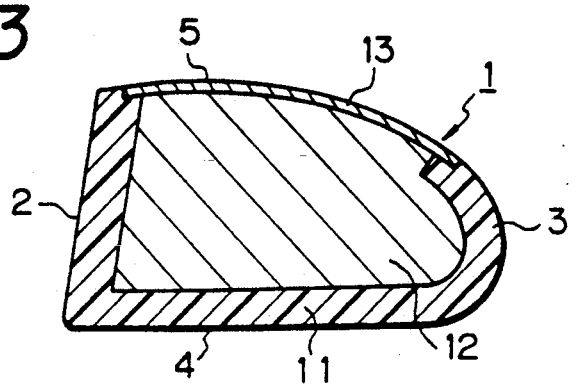
FIG. 3 is a section taken along a line III—III in FIG. 2.

As shown in FIGS. 2 and 3, the face 2, the back 3, the sole 4, the toe 6 and the heel 7 of the head main body 1 form the second shell 11 made of FRP which totally embrace a core 12 made of a soft material such as foam synthetic resin. Being flush with the shell 11, the crown 5 is formed with a low rigidity FRP shell 13, i.e. the first shell.

The FRP shell 11 contains a fibrous material such as rovings, plain weave cloths, twill weave cloths, bias cloth or mixture of these cloths. Carbon, glass, silica, boron or aromatic polyamide fibers are used solely or in mixture for these cloths. In production of the shell 11, the fibers are impregnated with synthetic resin such as epoxy, unsaturated polyester and epoxy acrylate for matrix and an impregnated FRP body is subjected to hardening via application of heat under pressure.

The elastic modulus of the shell 11 is in a range from 100 to 2500 GPa, and more preferable in a range form 150 to 250 GPa. The thickness of the shell 11 is in a range from 4 to 12 mm whilst varying depending on sections. Accordingly, since rigidity is proportional to the product of elastic modulus and $(\text{thickness})^3$, the rigidity is in the range of 6400 Newton* m $(100\times4^3)$ to 432,000 Newton* m $(250\times12^3)$.

In production of the low rigidity shell FRP 13 for the crown 55, polyester fibers such as polyethylene terephthalate or organic fibers such as aliphatic polyamide and polyvinyl acetate are used for reinforcement. These fibers are impregnated with synthetic resin such as epoxy, unsaturated polyester and epoxy acrylate for matrix. The impregnated FRP body is subjected to hardening via application of heat under pressure.

The elastic modulus of the low rigidity FRP shell 13 is in a range from 2 to 10 GPa, and more preferably in a range from 3 to 5 GPa.

At the border between the shell 11 and the low rigidity FRP shell 13, both fibrous materials exist in mixture as shown in FIG. 3.

The operation of the golf club head in accordance with the present invention will hereinafter be explained in detail in reference to FIGS. 4, 5A and 5B and 6–9.

Figure 6:
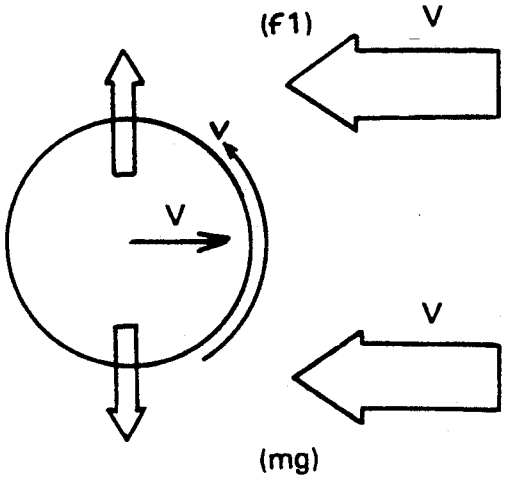
FIG. 6 illustrates the pneumatic conditions around a flying ball.
Figure 7:
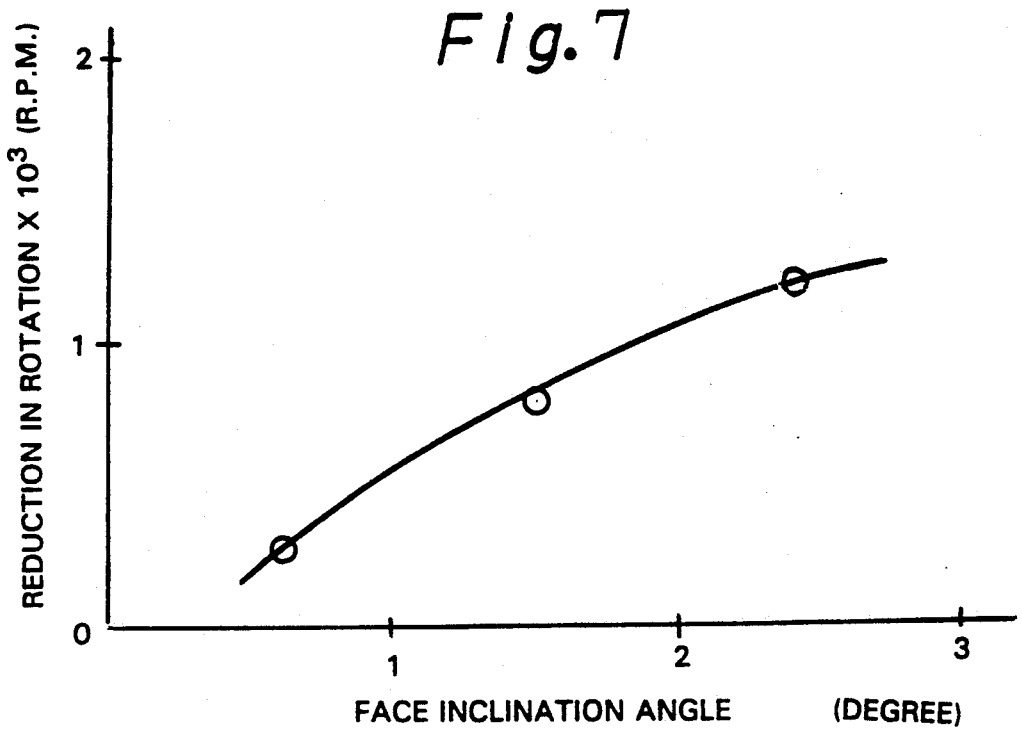
FIG. 7 shows the relationship between face inclination angle and crown rigidity.

FIG. 6 shows the pneumatic condition around a flying ball. It is here assumed that a ball of a radius "r" is advancing rightwards in the illustration at a speed "V" while rotating counterclockwise about its center of gravity. It is further assumed that this rotation of the ball causes the air around the ball surface to flow also counterclockwise at a speed "v".

With such assumptions, the air near the upper surface of the ball flows at a speed of "Vμ" which is equal to (V+v). While the air near the lower surface of the ball flows at a speed of "$V^d$" which is equal to (V−v). Due to this difference in air speed, the density of air near the upper surface of the ball becomes lower than that near the lower surface. This difference in air density generates pneumatic buoyancy.

The amount of this pneumatic buoyancy is proportional to the rotational speed of the ball about its center of gravity. As a consequence, the higher the rotation speed, the larger the pneumatic buoyancy.

A force acting on a ball at striking is divided into two components. The first component drives the ball forward while the second component rotates the ball about its center of gravity. In order to obtain a long shot, it is desirable to make the first component as large as possible. To this end, the second component should be as large a value as necessary for generating pneumatic buoyancy commensurate with gravity. When the second component exceeds this critical value, the first component is reduced accordingly and a shorter shot results.

When the general rule for wing buoyancy of a flying object is applied, the relationship between a ball speed "V" and a pneumatic buoyancy "FL" is given by the following equation:

$$FL=\tfrac{1}{2}*CL*V^2\rho*S$$

wherein

CL=coefficient of buoyancy

V=ball speed

ρ=density of air (1.293 kg/m$^3$)

S=projected surface area of the ball (1.43*10$^{-3}$m$^3$).

When a full swing is performed, the head speed is about 40 m/s for a golfer having a slow swing and about 45 m/s for a golfer having a quick swing. Since a full swing is usually performed in order to obtain the longest shot, lets take the case of a full swing. It is empirically known that the initial ball speed at striking is obtained by multiplying the head speed by 1.4. Then the ball speed resulting from a full swing is in a range from 56 to 63 m/s. Introducing this value into the above-described equation, the resultant value of the pneumatic buoyancy FL is in a range from 2.90*CL to 3.67*CL (kg*m/s$^2$).

The gravity acting on the ball is given by the product of its mass (m) with the acceleration of gravity (g=9.8 m/s$_2$). Since the mass of a ball is in general equal to about 45.9 g, the gravity acting on the ball is given by:

$$mg=0.0459*9.8=0.450\ (kg/s^2)$$

The pneumatic buoyancy (FL) to act on the ball must be commensurate with this value (mg). Introducing the values into an equation FL=mg, the coefficient of buoyancy (CL) is 0.155 for the head speed of 40 m/s and 0.123 for the head speed of 45 m/s. The relationship between the coefficient of buoyancy (CL) and rotational speed of a golf ball is known. See, for example, FIG. 6 of Golf Ball Aerodynamics, by P. W. Bearman and J. K. Harvey, Aeronautic Quarterly, (GBR), Vol. 27(2), pp. 112–122 (1976), the disclosure of which is incorporated by reference herein. From this known relationship, it is determined that the rotational speed is equal to 2,900 rpm for the head speed of 40 m/s and 2,000 rpm for the head speed of 45 m/s. From the foregoing analysis, it is understood that the rotational speed of a ball should be in a range from 2,000 to 2,900 rpm in order that the pneumatic buoyancy should be commensurate with gravity acting on the ball when a full swing is adopted. In the case of the conventional golf club head, rotation imposed upon a ball is more or less 3,200 rpm. In order that the pneumatic buoyancy should be commensurate with the gravity action on the ball, the conventional rotation has to be reduced by 300 to 1,200 rpm. This reduction in rotational speed is what is intended by the present invention.

Figure 9:
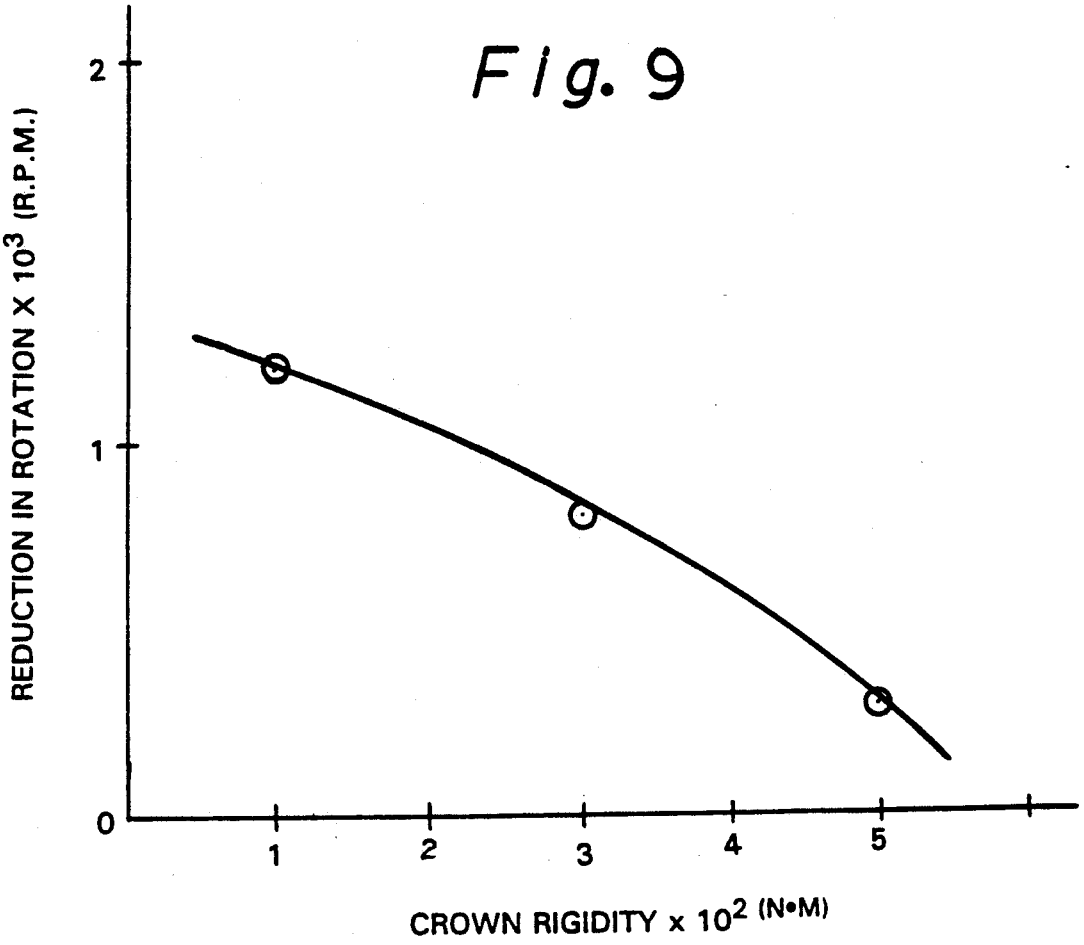
FIG. 9 shows the relationship between crown rigidity and rotational speed of a golf ball.
Figure 8:
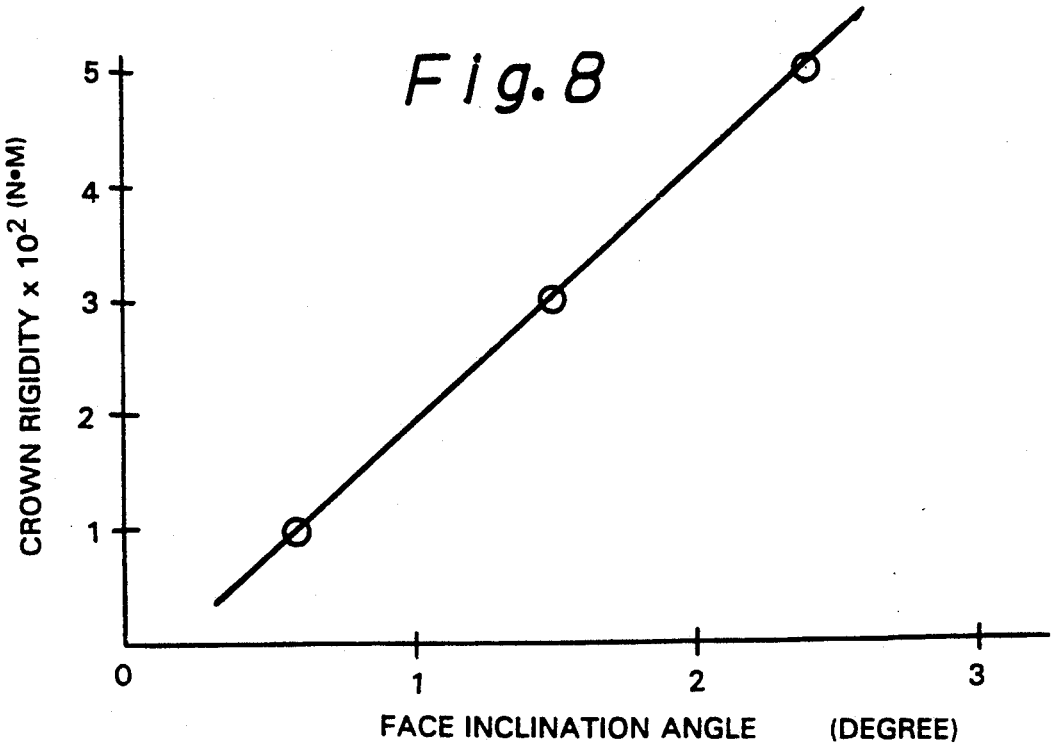
FIG. 8 shows the relationship between face inclination angle and reduction in rotational speed of a golf ball.

Rotational speed of a ball can be adjusted by the degree of inclination of the face of a golf club head. See FIG. 7 which shows the relationship between the face inclination angle (degree) and reduction in rotation (*10$^3$ rpm) of the ball. The degree of face inclination is closely related to the rigidity of the crown of the golf club head. This relationship is such as shown in FIG. 8 when the thickness of the crown is equal to 4 mm. From the two charts, the relationship between the crown rigidity and the reduction in rotation is obtained, which is shown in FIG. 9. As is clear from this chart, the rotational speed at striking decreases more than 1,200 rpm when the crown rigidity fall short of 100 (Newton* m) and, as a consequence, the resultant pneumatic buoyancy is not commensurate with the gravity acting on the ball. Whereas the number of rotation at striking decreases less than 300 rpm when the crown rigidity exceeds 500 (Newton* m). For these reasons, the reasonable crown rigidity should be in a range from 100 to 500 (Newton* m).

The rigidity of the crown is proportional to the product of elastic modulus with (thickness)$^3$. So even when the shell for the crown is made of a material which is the same as that used for other sections of the golf club head, the rigidity can be reduced by decreasing the thickness of the shell. In order to satisfy the above-described rigidity requirement, a stainless shell (elastic modulus=200 GPa) should have a thickness in a range from 0.75 to 1.35 mm. When carbon (50 GPa) is used, the thickness should be in a range from 1.25 to 2.15 mm. The thickness should be in a range from 2.92 to 5.00 mm when polyethylene (4 GPa) is used.

Rigidity is calculated on the basis of the average thickness of the crown. In general, a crown is uniform in thickness over its entire region. In practice, therefore, the thickness of one point on a crown can be regarded as being representative of its average thickness.

Figure 4:
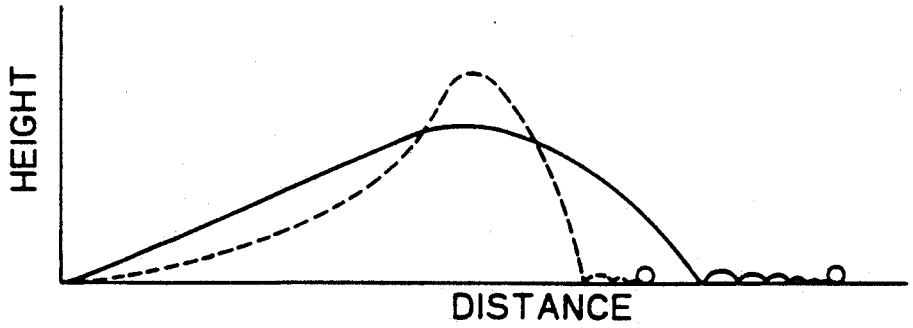
FIG. 4 is a graph for showing flying orbit of balls shot by the club head in accordance with the present invention (solid line) and by a conventional club head, (dotted line)

The flying orbits of a ball after striking by a club head are shown in FIG. 4, in which the distance of the orbit is taken on the abscissa and the height of the orbit is taken on the ordinate. The solid line is for a ball struck by the club head of the present invention whereas the dotted line is for a ball struck by a conventional club head. In the case of the club head in accordance with the present invention, no significant lift of the ball is observed despite its relatively large striking angle, thereby assuring an increased length. After landing the, a long run is obtained because its relatively small back spin. The ball shot by the conventional club head exhibits significant lift despite its relatively small shooting angle, thereby resulting in decreased length. In addition, its relatively large back spin hampers smooth run of the ball on the ground. Such a behaviour of the ball struck by the club head of the present invention is believed to result from the condition of the back spin which acts on the ball at the moment of shooting as explained below.

For measurement of the rotational behaviour of a ball B (see FIGS. 5A and 5B) at the moment of shooting, several latitudes and longitudes were marked on the ball just like the terrestrial globe. A stroboscope was used for intermittent illumination of the ball B at a time interval of 2 ms (mill-second).

During a period between the initial shot and 200 mm movement after the initial shot, the rotation angle of the ball was 29.0° for the conventional club head made of wood and 21.5° for the club head in accordance with the present invention. Significant reduction in rotation angle was observed. During this rotation, the moving speed in the lower section of the ball was faster than that in the upper section and the rotation of this mode is what is called "back spin".

Figure 5A:
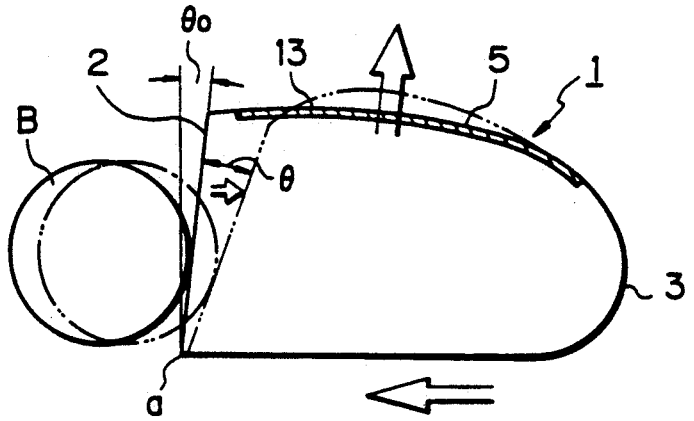
FIGS. 5A and 5B show behaviour of the club head in accordance with the present invention.
Figure 5B:
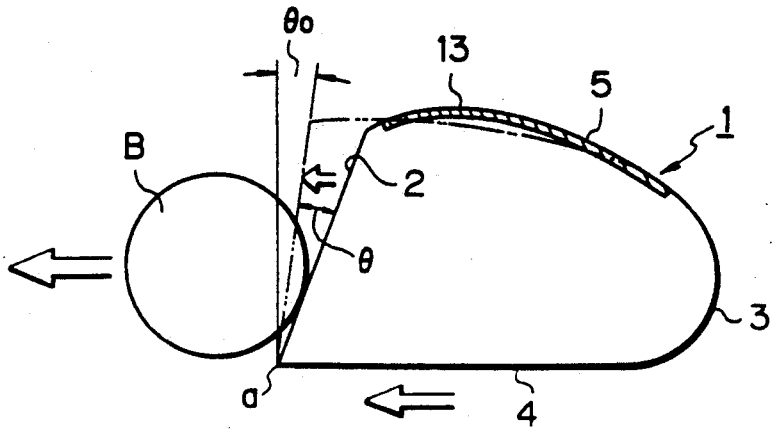

More specifically, in the drawings, the crown 5 exhibits an elastic deformation upwards as shown with a chain line in FIG. 5A at the very moment of impact on the ball B and the face 2 inclines rearwards, i.e. towards the back 3, about its bottom edge a over an angle of inclination $\theta$. As a result, the initial loft $\theta_o$ is increased to a loft $(\theta_o+\theta)$ whilst storing elastic energy. At the very moment of release of the ball B from the face 2 under this condition, the stored elastic energy is released to force the face 2 to return to its initial position over the angle $\theta$ and this movement of the face 2 suppresses application of back spin to the ball B. Thereby allowing ideal fly of the ball B along the orbit such as shown in FIG. 4.

In an alternative embodiment of the present invention, the low rigidity FRP shell 13 may be extended to the region of at least one of the toe 6 and the hosel 8. Further, the fist shell 13 may be made of a material other than the low rigidity FRP, for example, metal such as stainless steel, brass and titanium.

For confirmation of the merits of the invention, balls were shot at initial head speeds of 38 and 45 m/s using a wood golf club in accordance with the present invention and a conventional wood golf club, respectively. The results, i.e., the carry distance, the run distance and the total distance for each test are given in Table I.

TABLE I

| | Head speed (m/s) | |
|---|---|---|
| | 38 | 45 |
| Conventional | | |

TABLE I-continued

| | Head speed (m/s) | |
|---|---|---|
| | 38 | 45 |
| carry distance (m) | 186 | 221 |
| run distance (m) | 20 | 10 |
| total distance (m) | 206 | 231 |
| Inventional | | |
| carry distance (m) | 177 | 222 |
| run distance (m) | 27 | 13 |
| total distance (m) | 204 | 235 |

In accordance with the present invention, the head speed of 38 m/s assures increased run but reduced carry. This combination of distance, however, well indicates the fact that the ball filed along a low course. In contrast to this, the head speed of 45 m/s results in significant increase in both of carry and run.

In accordance with the present invention, the low rigidity of the crown allows its upward elastic deformation and resultant rearward movement of the face at shooting a ball whilst storing elastic energy in the crown. As a consequence, the head main body has a temporarily increased loft at the very moment of ball release from the face, thereby assuring increased long shot with reduced application of undesirable back spin to the ball. In addition to increase in flying distance due to the increased loft, suppressed back spin allows longer run of the ball after fall on the ground.

I claim:

1. A wood golf club head comprising a face, a sole, a back, a crown, a toe and a heel, the crown being made of a first shell and the face, the sole, the back, the toe and the heel being made of a second shell, the first shell being made of a first material having an elastic modulus in a range from 2 to 10 GPa and a thickness in a range from 4 to 12 mm and the second shell being made of a material different from the first shell and having an elastic modulus in a range from 150 to 250 GPa and a thickness such that the rigidity of the second shell is greater than that of the first shell whereby the crown exhibits upward elastic deformation upon striking a ball and allows the face to incline rearwardly so as to control the loft of the face.

2. A wood golf club head comprising a face, a sole, a back, a crown, a toe and a heel, the crown being made of a first shell and the face, the sole, the back, the toe and the heel being made of a second shell, the first shell being made of a first material having an elastic modulus of 210 GPa and a thickness in a range from 0.5 to 1.5 mm and the second shell being made of a material different from the first shell and having an elastic modulus in a range from 150 to 250 GPa and a thickness such that the rigidity of the second shell is greater than that of the first shell whereby the crown exhibits upward elastic deformation upon striking a ball and allows the face to incline rearwardly so as to control the loft of the face.

* * * * *